US010623854B2

(12) United States Patent
Goesnar et al.

(10) Patent No.: US 10,623,854 B2
(45) Date of Patent: Apr. 14, 2020

(54) SUB-BAND MIXING OF MULTIPLE MICROPHONES

(71) Applicant: Dolby Laboratories Licensing Corporation, San Francisco, CA (US)

(72) Inventors: Erwin Goesnar, Daly City, CA (US); David Gunawan, Sydney (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 214 days.

(21) Appl. No.: 15/560,955

(22) PCT Filed: Mar. 21, 2016

(86) PCT No.: PCT/US2016/023484
§ 371 (c)(1),
(2) Date: Sep. 22, 2017

(87) PCT Pub. No.: WO2016/154150
PCT Pub. Date: Sep. 29, 2016

(65) Prior Publication Data

US 2018/0176682 A1 Jun. 21, 2018

Related U.S. Application Data

(60) Provisional application No. 62/138,220, filed on Mar. 25, 2015.

(51) Int. Cl.
*H04R 3/00* (2006.01)
*G10L 21/0364* (2013.01)
(Continued)

(52) U.S. Cl.
CPC ..... *H04R 3/005* (2013.01); *G10L 21/0216* (2013.01); *G10L 21/0364* (2013.01); *G10L 25/18* (2013.01); *G10L 25/21* (2013.01); *G10L 21/0208* (2013.01); *G10L 2021/02082* (2013.01); *G10L 2021/02166* (2013.01); *H04R 2430/03* (2013.01)

(58) Field of Classification Search
CPC ..... H04R 3/005; H04R 25/407; H04R 25/43; H04R 2430/01; H04R 2430/03;
(Continued)

(56) References Cited

U.S. PATENT DOCUMENTS 5,574,824 A 11/1996 Slyh
6,246,760 B1 6/2001 Makino
(Continued)

FOREIGN PATENT DOCUMENTS

EP 1343351 9/2003
JP 05-113794 1/2013
(Continued)

*Primary Examiner* — Davetta W Goins
*Assistant Examiner* — Daniel R Sellers

(57) ABSTRACT

Input audio data portions of a common time window index value generated by multiple microphones at a location are received. Subband portions are generated from the input audio data portions. Peak powers, noise floors, etc., are individually determined for the subband portions. Weights for the subband portions are computed based on the peak powers, the noise floors, etc., for the subband portions. An integrated audio data portion of the common time window index is generated based on the subband portions and the weight values for the subband portions. An integrated signal may be generated based at least in part on the integrated audio data portion.

20 Claims, 7 Drawing Sheets

(51) Int. Cl.

| | |
|---|---|
| ***G10L 21/0216*** | (2013.01) |
| ***G10L 25/18*** | (2013.01) |
| ***G10L 25/21*** | (2013.01) |
| ***G10L 21/0208*** | (2013.01) |

(58) Field of Classification Search

CPC ..... H04R 2430/20; H04R 2430/21; H04R 2430/23; H04R 2430/25; G10L 21/0216; G10L 21/0364; G10L 21/0208; G10L 25/18; G10L 25/21; G10L 2021/02082; G10L 2021/02166; H04M 3/56; H04M 3/567; H04M 3/568; H04M 3/569; H04M 2203/509

See application file for complete search history.

(56) References Cited

U.S. PATENT DOCUMENTS

| | | | | |
|---|---|---|---|---|
| 8,098,844 | B2 | 1/2012 | Elko | |
| 8,588,427 | B2 | 11/2013 | Uhle | |
| 8,761,410 | B1 | 6/2014 | Avendano | |
| 8,849,656 | B2 | 9/2014 | Schmidt | |
| 9,520,140 | B2 | 12/2016 | Goesnar | |
| 2003/0063759 | A1* | 4/2003 | Brennan | H04R 3/005 381/92 |
| 2006/0013412 | A1 | 1/2006 | Goldin | |
| 2009/0220109 | A1* | 9/2009 | Crockett | H03G 3/3089 381/107 |
| 2013/0325458 | A1* | 12/2013 | Buck | H03G 3/3005 704/226 |
| 2014/0148224 | A1 | 5/2014 | Truong | |
| 2014/0211951 | A1 | 7/2014 | Paranjpe | |
| 2014/0270219 | A1 | 9/2014 | Yu | |
| 2014/0270241 | A1 | 9/2014 | Yu | |
| 2015/0030180 | A1 | 1/2015 | Sun | |
| 2017/0164133 | A1 | 6/2017 | Gunawan | |

FOREIGN PATENT DOCUMENTS

| | | |
|---|---|---|
| WO | 03/015464 | 2/2003 |
| WO | 2009/042385 | 4/2009 |
| WO | 2012/074503 | 6/2012 |
| WO | 2014/168777 | 10/2014 |

* cited by examiner

SUB-BAND MIXING OF MULTIPLE MICROPHONES

CROSS-REFERENCE TO RELATED APPLICATIONS

This application claims the benefit of priority to U.S. Provisional Application No. 62/138,220, filed on 25 Mar. 2015, hereby incorporated by reference in its entirety.

The present application is related to International Patent Application No. PCT/US2015/038866 filed on 1 Jul. 2015. The present application is also related to International Patent Application No. PCT/US2014/032407 filed on 31 Mar. 2014. The above-mentioned patent applications are assigned to the assignee of the present application and are incorporated by reference herein.

TECHNOLOGY

The present invention relates generally to audio processing. More particularly, embodiments of the present invention relate to subband mixing of multiple microphone signals.

BACKGROUND

In an audio mixer operating with multiple microphones, multiple microphone signals may be processed by gating. For example, some of the microphones may be muted by gating when active talkers are not detected with these microphones. This approach has a few disadvantages. First, fluctuations in perceived timbre and sound level are fairly noticeable perceptually when microphones are switched between a muted state and an unmuted state by gating. These audio artifacts can be fairly pronounced especially when there is either a false-negative miss of an active talker or a false-positive detection of a non-existent active talker. Second, when multiple talkers from different microphones are active at the same time, the noise and reverberation levels in the audio mix generated by the audio mixer tend to increase.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE EMBODIMENTS

Figure 1A:
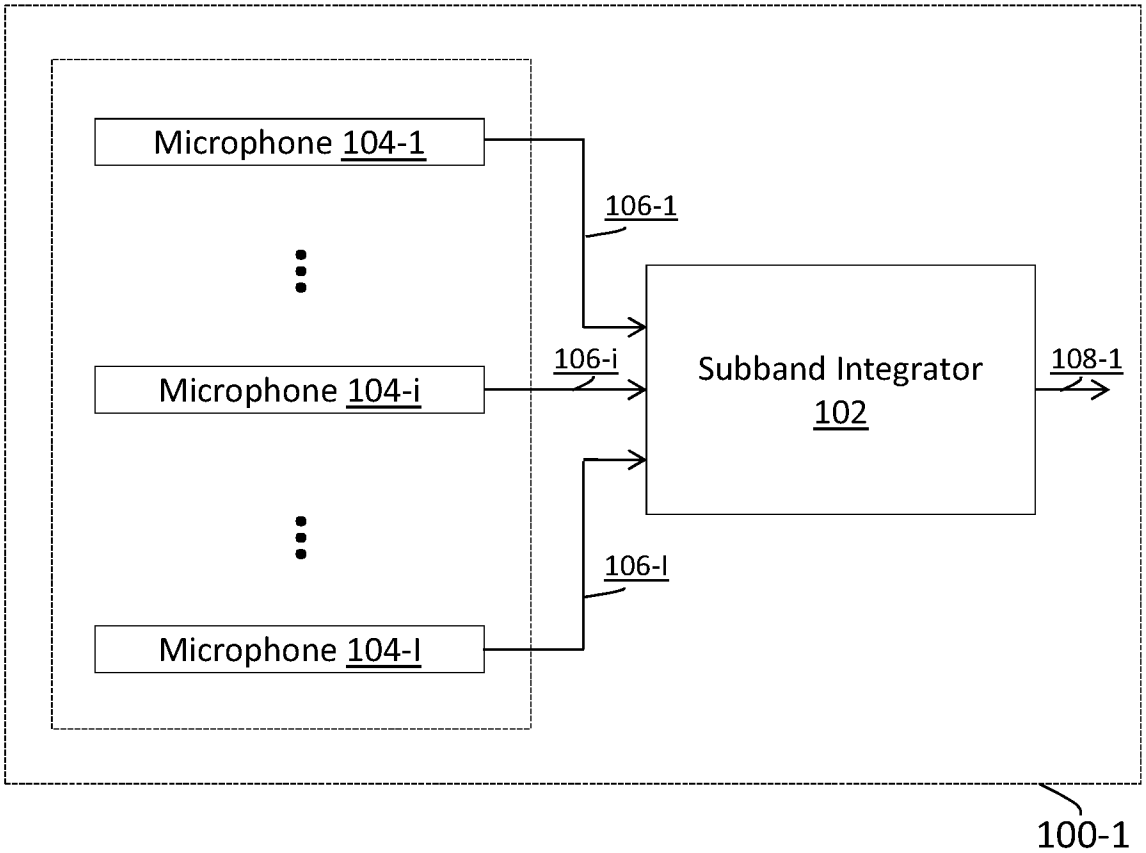
FIG. 1A and FIG. 1B illustrate example configurations in which two or more microphones are deployed.

Example embodiments, which relate to subband mixing of multiple microphone signals, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Example embodiments are described herein according to the following outline:

1. GENERAL OVERVIEW
2. STRUCTURAL OVERVIEW
3. SUBBAND INTEGRATOR
4. PEAK POWER TRACKER
5. SPECTRAL SMOOTHING OF PEAK POWERS
6. REFERENCE AND AUXILIARY MICROPHONE SIGNALS
7. EXAMPLE PROCESS FLOWS
8. IMPLEMENTATION MECHANISMS—HARDWARE OVERVIEW
9. EQUIVALENTS, EXTENSIONS, ALTERNATIVES AND MISCELLANEOUS

1. General Overview

This overview presents a basic description of some aspects of an example embodiment of the present invention. It should be noted that this overview is not an extensive or exhaustive summary of aspects of the example embodiment. Moreover, it should be noted that this overview is not intended to be understood as identifying any particularly significant aspects or elements of the example embodiment, nor as delineating any scope of the example embodiment in particular, nor the invention in general. This overview merely presents some concepts that relate to the example embodiment in a condensed and simplified format, and should be understood as merely a conceptual prelude to a more detailed description of example embodiments that follows below.

Techniques as described herein can be used to perform multichannel microphone signal processing. Under these techniques, multiple microphone signals captured with multiple microphones can be combined into an integrated signal that enhances direct sound of speech components in the multiple microphone signals and minimizes noise components and reverberations as compared with other approaches. The multiple microphones can be deployed in a wide variety of configurations such as at a broadcast studio to capture commentators' voices, in a conference room to capture participants' voices, etc. A variety of microphones such as soundfield microphones, satellite microphones, ceiling mounted microphones, etc., can be used as some or all of the multiple microphones to capture the participants' voices in various positions in a given configuration.

To improve voice quality of an integrated signal, multiple microphone signals can be combined using subband mixing techniques that enhance or emphasize direct sound of voices present in the microphone signals, while at the same time minimize reverberations, noises, etc., in the integrated signal. These subband mixing techniques may first transform each microphone signal in the multiple microphone signals into frequency audio data portions in a time-frequency domain. Each of the frequency audio data portions may correspond to a specific frequency band (e.g., a 20 Hz frequency band, a 25 Hz frequency band, a 30 Hz frequency band, a 100 Hz frequency band, etc.) in a plurality of constant-sized frequency bands in a specific time window (e.g., a 5 millisecond time window, a 10 millisecond time window, a 15 millisecond time window, a 20 millisecond time window, a 30 millisecond time window, etc.) in a plurality of time windows.

The frequency audio data portions in the plurality of frequency bands may be further banded into subband audio data portions (or simply subband portions) in soft bands such as equivalent rectangular bandwidth (ERB) bands in an ERB domain or scale, etc. Subband portions—across the multiple microphone signals—of an ERB band in a time window may form a set of subband portions that are assigned respective weights based on measures of powers and noise floors determined for the subband portions; the set of subband portions can be combined into an integrated subband portion of the ERB band in the time window.

Under techniques as described herein, the measures of powers used for determining the weights for combining the subband portions into the integrated portion may be derived based on smoothed spectral powers determined for the subband portions. As used herein, a smoothed spectral power of a soft band in a time window may comprise spectrally smoothed contributions of estimated peak powers of one, two or more soft bands that include the soft band in the same time window.

To take into account speech characteristics such as frequency-dependent power variations, intonations related to speech intelligibility, reverberations (e.g., trailing tails following bursts of signal energy from direct sound, asymmetric decays following onsets of direct sounds, etc.), etc., a (time-wise) smoothing filter may be applied to banded peak power of subband portions in a current time window and previously estimated peak powers of subband portions in a previous time window to obtain estimated peak powers for the subband portions in the current time window. A smoothing filter as described herein may be applied with a smoothing factor (e.g., a smoothing constant, etc.) that is chosen to enhance direct sound and a decay factor (e.g., a decay constant, etc.) that is chosen to suppress reverberations.

If a smoothed spectral power of a subband portion of a microphone signal for a subband in a time window is above the maximum noise floor and smoothed spectral power of subband portions of all other microphone signals for the same subband and the window, a weight for the subband portion of the microphone signal may be set to be proportional to, or scales with, the smoothed spectral power of the subband portion.

As a result, the larger the smoothed spectral power of the subband portion of the microphone signal above the maximum noise floor and smoothed spectral power in the subband portions of the other microphone signals, the larger the weight the subband portion is assigned. This relatively large weight combined with the relatively large smoothed spectral power of the subband portion to begin with can be used to enlarge the contribution of the subband to the integrated subband portion. Therefore, if speech—as indicated by or correlated to the smoothed spectral power above the signal levels in the subband portions of the other microphone signals—is detected, contributions to the integrated subband portion by the subband portion containing the speech are enhanced or amplified by the weight assigned to the subband portion containing the speech.

If a smoothed spectral power of a subband portion of a microphone signal for a subband and a time window is not above the maximum noise floor of all other subband portions of all other microphone signals for the same subband and the time window, this may indicate that no speech activity is detected in the subband and the time window. Instead of concentrating on or directing to the strongest microphone signal (which may comprise much noise with little speech) as under other approaches, under techniques as described herein, if no speech activity is detected in the subband and the time window, a weight for the subband portion of the microphone signal may be set to be proportional to, or scale with, the maximum noise floor of subband portions of other microphone signals. As a result, if a noise floor of the subband portion is above the maximum noise floor of subband portions of all other microphone signals, the contribution of the subband portion to the integrated subband portion is not proportional, or does not scale with, the noise floor of the subband portion, but rather depends on noise floors of the subband portions of the other microphone signals that are lower than the noise floor of the subband portion. Further, if a noise floor of the subband portion is not above the maximum noise floor of all other subband portions of all other microphone signals, the contribution of this less noisy subband portion to the integrated subband portion may be elevated with a weight that is higher than another weight assigned to noisier subband portions, because the weight for the subband portion is set to be proportional, or scale with, the maximum noise floor of subband portions of other microphone signals. As a result, if no speech is detected to be above the noise floors, contributions of noisier subband portions to the integrated subband portion are suppressed, whereas contributions of less noisy subband portions to the integrated subband portion are less suppressed.

As compared with other approaches (e.g., gating-based algorithms, full-band mixing algorithms, etc.) that do not implement the techniques as described herein, the subband mixing techniques as described herein provide a number of distinct benefits and advantages, which may include but are not limited to only what has been described and what follows.

For example, measures of powers, weights, etc., as described herein may be calculated and updated for every time window and every subband. Thus these values can be determined or computed with minimal delays in time based on audio samples or their amplitude information in a very limited number of time windows.

In addition, the integration of multiple microphone signals are performed on a subband basis under the techniques as described herein. When a talker's voice comprises a frequency spectrum covering one or more specific subband portions (e.g., a frequency spectrum around 250 Hz, a frequency spectrum around 500 Hz, etc.), onsets of the talker's voice such as bursts of signal energy in subband portions corresponding to the talker's voice frequencies, etc., can be picked up relatively fast under the techniques as described herein based on measures of powers, weights, etc., calculated and updated on the basis of subband portions.

As noted, since the measures of powers used to determine the weights of subband portions in a current time window can be determined (e.g., entirely, substantially, in parallel, etc.) based on values for the current time window and a previous time window immediately preceding the current time window, the subband mixing techniques as described herein can be configured to react to (e.g., bursts, onsets, etc.) direct sound in speech components within a relatively small time window of 5 milliseconds, 10 milliseconds, 20 milliseconds, etc. As a result, talkers and their respective speech activities can be tracked relatively fast. Utterances (e.g., related to vowels, consonants, short or long syllables, etc.) from the talkers can be captured relatively responsively, clearly and faithfully.

Furthermore, even while voices from different talkers may overlap in time in frequency in the multiple microphone signals, because the measures of powers used to compute weights are over time and over frequency-dependent soft bands, voice characteristics such as perceived timbre, etc., can be preserved/maintained relatively consistently during an onset of utterances. More specifically, since the weights for subband portions are computed with spectrally smoothed powers, the enhancement or amplification of speech audio data is not narrowly focused at frequencies at which a talker's voice has the strongest banded peak powers, but rather is extended over a relatively large portion of a frequency spectrum of a talker's voice and over one or more time windows (e.g., by the smoothing factor $\alpha$, etc.), for example over several ERB bands. As a result, fluctuations in perceived timbre and sound level, which may be pronounced in other approaches, can be reduced or avoided to a relatively large extent under the techniques as described herein.

Since the techniques as described herein support audio processing with minimal delays (e.g., a single time window of 5 milliseconds, 10 milliseconds, 20 milliseconds, etc.) and maximal sensitivity to speech activities in any specific subband portion (e.g., subbands around 250 Hz, subbands around 500 Hz, etc.), these techniques can be used to optimally support both live audio processing and delayed/recorded audio processing in a telecommunications system, a live event broadcast system, a recording system, etc.

Additionally, optionally, or alternatively, an integrated signal generated with the techniques as described herein from multiple microphones represents a relatively clean speech signal in which reverberations, noises, etc., are suppressed and direct sound of speech components are enhanced or amplified to improve speech intelligibility. This clean speech signal can be further integrated into a soundfield signal with or without other mono audio signals (e.g., from other spatial locations, etc.), etc. For example, a soundfield signal (e.g., a B-format signal, etc.) generated by a soundfield microphone may be partitioned into an original mono signal (e.g., a W-channel signal, a mono downmix of a soundfield signal, etc.) and a remainder soundfield signal (e.g., X-channel and Y-channel signals, a subset of multichannel signals, etc.) without the original mono signal. The remainder sound field signal without the original mono signal may be combined with an integrated signal derived from multiple microphones to generate a new soundfield signal.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. Structural Overview

Techniques as described herein can be used with multiple microphones deployed in a wide variety of spatial configurations. Multiple microphones as described herein may be deployed at a spatial location as a combination of any of discrete microphone elements, microphone arrays, microphone elements of a single microphone type, microphone elements of two or more different microphone types, multiple microphones comprising at least one soundfield microphone, microphones in B-format arrays, auxiliary microphones operating in conjunction with main or reference microphones, lapel microphones, satellite microphones, microphones in conference phone devices, spot microphones in a live event venue, internal microphones in electronic devices, mounted microphones, portable microphones, wearable microphones, etc. FIG. 1A illustrates an example configuration 100-1 in which two or more microphones (e.g., 104-1, **104-*i*, 104-I, etc.) are used to capture spatial pressure waves occurring (e.g., locally) at or in a spatial location 100-1 and generate, based on the captured spatial pressure waves, two or more respective microphone signals (e.g., 106-1, 106-*i*, 106-I, etc.). The two or more microphones (e.g., 104-1, 104-*i*, 104-I, etc.) may be of the same type of microphone or alternatively may be of two or more types of microphones. A microphone (e.g., 104-1, 104-*i*, 104-I, 104-W of FIG. 1**B, etc.) as described herein one or more of omnidirectional microphone, directional microphone, cardioid microphones, dipole microphones, microphone arrays, electret microphones, condenser microphones, crystal microphones, piezoelectric transducers, electromagnetic microphones, ribbon microphones, etc.

A spatial location (e.g., 100-1 of FIG. 1A, 100-2 of FIG. 1B, etc.) as described herein may refer to a local, relatively confined, environment at least partially enclosed, such as an office, a conference room, a highly reverberated room, a studio, a hall, an auditorium, etc., in which multiple microphones as described herein operate to capture spatial pressure waves in the environment for the purpose of generating microphone signals. A specific spatial location may have a specific microphone configuration in which multiple microphones are deployed, and may be of a specific spatial size and specific acoustical properties in terms of acoustic reflection, reverberation effects, etc.

The two or more microphone signals (e.g., 106-1, **106-*i*, 106-I, etc.) respectively generated by the two or more microphones (e.g., 104-1, 104-*i*, 104-I, etc.) can be processed and integrated by a subband integrator 102 into an integrated signal 108-1. In some embodiments, a microphone (e.g., 104-*i*, etc.) in the multiple microphones (e.g., 104-1, 104-*i*, 104**-I, etc.) may be indexed by a positive integer (e.g., a positive integer i between 1 and a positive integer number I no less than two, etc.).

Figure 1B:
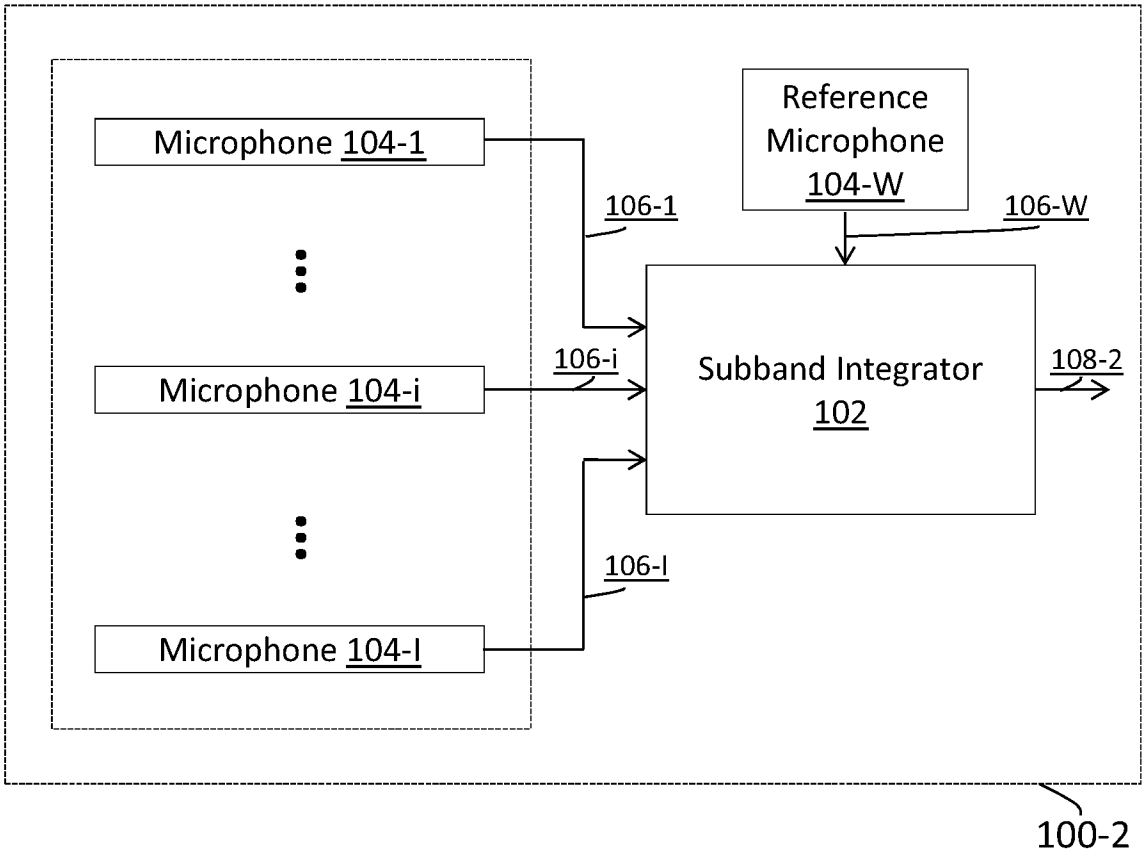

FIG. 1B illustrates an example configuration 100-2 in which two or more microphones (e.g., 104-1, **104-*i*, 104-I, etc.) and a reference microphone (e.g., 104-W, etc.) are used to capture spatial pressure waves occurring (e.g., locally) at or in a spatial location 100-2 and generate, based on the captured spatial pressure waves, two or more respective microphone signals (e.g., 106-1, 106-*i*, 106-I, etc.) and a reference microphone signal (e.g., 106-W, etc.). The two or more respective microphone signals (e.g., 106-1, 106-*i*, 106-I, etc.) respectively generated by the two or more microphones (e.g., 104-1, 104-*i*, 104-I, etc.), and the reference microphone signal (e.g., 106-W, etc.) captured by the reference microphone (e.g., 104-W, etc.), can be processed and integrated by a subband integrator (e.g., 102, etc.) into an integrated signal 108-2**.

In some embodiments, the subband integrator (102) is at the same spatial location (e.g., shown in FIG. 1A or FIG. 1B, etc.) as the spatial location (e.g., 100-1, 100-2, etc.) at which the microphones capture spatial pressure waves and generate microphone signals to be processed by the subband integrator (102) into an integrated signal.

In some embodiments, the subband integrator (102) is at a different spatial location (not shown) from the spatial location (e.g., 100-1, 100-2, etc.) at which the microphones capture spatial pressure waves and generate microphone signals to be processed by the subband integrator (102) into an integrated signal.

The two or more microphones (e.g., 104-1, **104-*i*, 104-I, etc.) may or may not be of the same type of microphone. In some embodiments, the reference microphone (104-W) is of a different type of microphone from all of the two or more microphones (e.g., 104-1, 104-*i*, 104-I, etc.). For example, the reference microphone (104-W) may be a soundfield microphone internally housed in a conference phone device, whereas the two or more microphones (e.g., 104-1, 104-*i*, 104-I, etc.) may be desk phone devices, external microphones, etc., that comprises non-soundfield microphones. In some embodiments, the reference microphone (104-W) is of a same type of microphone as at least one of the two or more microphones (e.g., 104-1, 104-*i*, 104-I, etc.). For example, the reference microphone (104-W) may be a soundfield microphone internally housed in a conference phone device, whereas at least one of the two or more microphones (e.g., 104-1, 104-*i*, 104**-I, etc.) may also be a soundfield microphone, or a part (e.g., a W-channel microphone element in the sound field microphone, etc.) thereof.

In some embodiments, a microphone (e.g., reference microphone 104-W, a non-reference microphone **104-*i*, etc.) as described herein may comprise multiple component microphone elements. For example, the microphone may comprise an omnidirectional microphone element as well as dipole microphone elements, etc. A microphone signal (e.g., reference microphone signal 106-W, a non-reference microphone signal 106-*i***, etc.) as described herein may be a (e.g., mono, etc.) downmix or upmix of component microphone signals acquired by respective component microphone elements in a microphone that comprises the component microphones.

In some embodiments, the subband integrator (102) may or may not be a standalone device. In various embodiments, a subband integrator (e.g., 102, etc.) as described herein can be a part of, or operate in conjunction with, an audio processing device such as a conference phone device, a studio-based audio processor, a recording device, etc. The subband integrator (102) may be implemented at least in part with one or more of general purpose single- or multi-chip processors, digital signal processors (DSPs), application specific integrated circuits (ASICs), field programmable gate arrays (FPGAs) or other programmable logic device, memory devices, network interfaces, data connection interfaces, discrete gate or transistor logic, discrete hardware components and/or combinations thereof.

3. Subband Integrator

Figure 2:
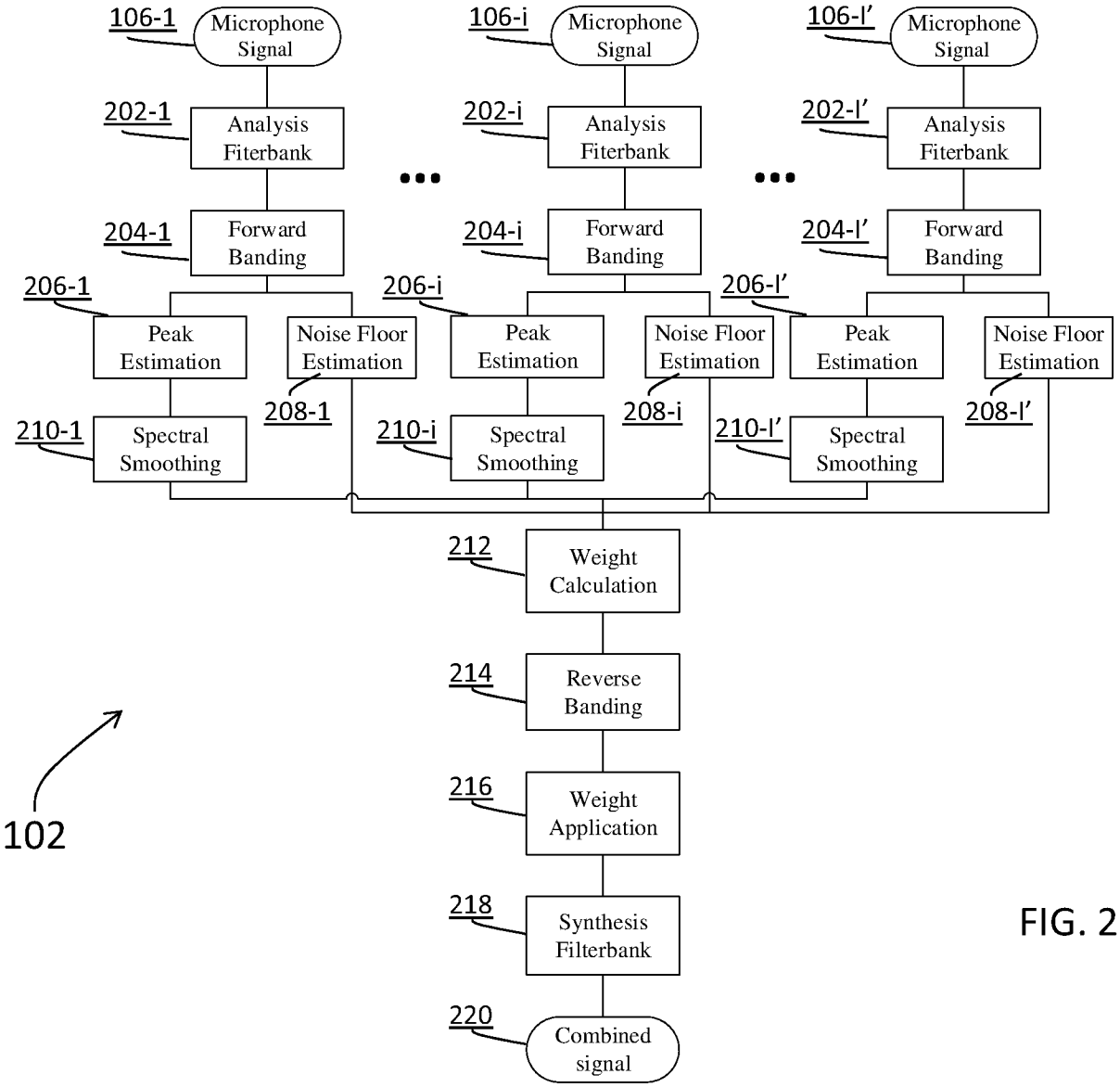
FIG. 2 illustrates an example subband integrator.

FIG. 2 illustrates an example subband integrator (e.g., 102, etc.). In some embodiments, the subband integrator (102) comprises one or more of network interfaces, audio data connections, audiovisual data connections, etc.; and receives, from one or more of network interfaces, audio data connections, audiovisual data connections, etc., two or more microphone signals (e.g., 106-1, **106-*i*, 106**-I', etc.) from two or more microphones deployed at a spatial location.

In a non-limiting example, the two or more microphone signals (e.g., 106-1, **106-*i*, 106-I', etc.) represent the two or more microphone signals (e.g., 106-1, 106-*i*, 106-I, etc.), as illustrated in FIG. 1A. In another non-limiting example, the two or more microphone signals (e.g., 106-1, 106-*i*, 106-I', etc.) represent the two or more microphone signals (e.g., 106-1, 106-*i*, 106-I, etc.) and the reference microphone signal (e.g., 106-W, etc.), as illustrated in FIG. 1B. Some or all of the received microphone signals may, but are not required to only, comprise time domain audio data (e.g., PCM audio data, audio signal samples obtained at one or more sampling rates, etc.). For the purpose of illustration, each of the microphone signals (e.g., 106-1, 106-*i*, 106-I', etc.) may comprise a time-sequential series of audio sensor data generated from sensory responses of two or more microphones, respectively, to spatial pressure waves occurring at a spatial location (e.g., 100-1, 100-2, etc.) where the two or more microphones are deployed. In some embodiments, the subband integrator (102) comprises software, hardware, a combination of software and hardware, etc., configured to perform two or more analysis filterbank operations (e.g., 202-1, 202-*i*, 202-I', etc.). The two or more analysis filterbank operations (e.g., 202-1, 202-*i*, 202-I', etc.) may be configured to operate in parallel, in series, partly in parallel partly in series, etc., to respectively process the received two or more microphone signals (e.g., 106-1, 106-*i*, 106**-I', etc.) into frequency domain audio data portions in a time-frequency domain.

For example, an analysis filterbank operation (**202-*i*) may logically divide a time interval (e.g., seconds, minutes, hours, etc.) into a sequence of (e.g., equal time length, etc.) time windows (e.g., 1st time window, 2nd time window, (n−1)-th time window, n-th time window, (n+1)-th window, etc.) indexed by a time window index n. For each time window (e.g., 10 milliseconds, 20 milliseconds, 30 milliseconds, etc.) in the sequence of time windows, each of the two or more analysis filterbank operations (e.g., 202-1, 202-*i*, 202-I', etc.) processes audio data of a respective microphone signal in the two or more microphone signals (e.g., 106-1, 106-*i*, 106**-I', etc.) in the time window (e.g., a n-th time window) into a (e.g., 1st, i-th, I'-th, etc.) plurality of frequency domain audio data portions over a plurality of (e.g., constant-sized, etc.) frequency subbands. The number of frequency subbands may be a value in the range of 100-500, 500-1000, 1000-2000, or in some other range.

As a result, two or more pluralities of frequency domain audio data portions over the plurality of (e.g., constant-sized, etc.) frequency subbands are generated for the time window; each plurality of frequency domain audio data portions in the two or more pluralities of frequency domain audio data portions corresponds to, or is (e.g., substantially, entirely, etc.) originated from, the audio data of a respective microphone signal in the two or more microphone signals (e.g., 106-1, **106-*i*, 106-I', etc.) in the time window (e.g., the n-th time window). To reduce computational complexity, a frequency-dependent power distribution of a microphone signal (e.g., 106-*i***, etc.) may be grouped and computed (e.g., integrated, summed, etc.) over each of a plurality of ERB subbands in an ERB domain. In some embodiments, a total of T ERB subbands that are located in some or all of the audio frequency range audible to the human auditory system make up the plurality of ERB subbands in the ERB domain as described herein; T may be an integer ranging from 5-10, 10-40, 40-80, or in some other range.

In some embodiments, the subband integrator (102) comprises software, hardware, a combination of software and hardware, etc., configured to perform two or more forward banding operations (e.g., 204-1, **204-*i*, 204-I', etc.). The two or more forward banding operations (e.g., 204-1, 204-*i*, 204**-I', etc.) may be configured to operate in parallel, in series, partly in parallel partly in series, etc., to respectively group the two or more pluralities of frequency domain audio data portions over the plurality of (e.g., constant-sized, etc.) frequency subbands into two or more pluralities of ERB subband audio data portions (or simply subband portions)

over the plurality of ERB subbands in the ERB domain. For example, a forward banding operation (e.g., 204-*i*, etc.) may be configured to operate in parallel, in series, partly in parallel partly in series, etc., with other forward banding operations (e.g., 204-1, 204-I', etc.) to group an i-th plurality of frequency domain audio data portions in the two or more pluralities of frequency domain audio data portions over the plurality of (e.g., constant-sized, etc.) frequency subbands into an i-th plurality of ERB subband audio data portion in the two or more pluralities of ERB subband audio data portions (or simply subband portions) over the plurality of ERB subbands in the ERB domain.

In some embodiments, the subband integrator (102) comprises software, hardware, a combination of software and hardware, etc., configured to perform two or more noise floor estimation operations (e.g., 208-1, 208-*i*, 208-I', etc.). The two or more noise floor estimation operations (e.g., 208-1, 208-*i*, 208-I', etc.) may be configured to operate in parallel, in series, partly in parallel partly in series, etc., to respectively estimate a noise floor for each ERB subband audio data portion (or simply subband portion) in the two or more pluralities of ERB subband audio data portions over the plurality of ERB subbands in the ERB domain. For example, a noise floor estimation operation (e.g., 208-*i*, etc.) may be configured to operate in parallel, in series, partly in parallel partly in series, etc., with other noise estimation operations (e.g., 208-1, 208-I', etc.) to estimate a noise floor for each subband portion in an i-th plurality of subband portions of the two or more pluralities of ERB subband audio data portions over the plurality of ERB subbands in the ERB domain.

The use of a particular noise estimation technique is not critical. One or more in a variety of noise estimation techniques such as based on voice activity detection, minimum statistics, signal-to-noise ratios, etc., may be used with a noise floor estimation operation (e.g., 208-*i*, etc.) as described herein to determine or estimate a noise floor for a subband portion that comprises audio data composed of speech and noise components, noise components alone, etc.

In some embodiments, the subband integrator (102) comprises software, hardware, a combination of software and hardware, etc., configured to perform two or more peak estimation operations (e.g., 206-1, 206-*i*, 206-I', etc.). The two or more peak estimation operations (e.g., 206-1, 206-*i*, 206-I', etc.) may be configured to operate in parallel, in series, partly in parallel partly in series, etc., to respectively estimate a peak power for each ERB subband audio data portion (or simply subband portion) in the two or more pluralities of ERB subband audio data portions over the plurality of ERB subbands in the ERB domain. For example, a peak estimation operation (e.g., 206-*i*, etc.) may be configured to operate in parallel, in series, partly in parallel partly in series, etc., with other peak estimation operations (e.g., 206-1, 206-I', etc.) to estimate a peak power for each subband portion in an i-th plurality of subband portions of the two or more pluralities of ERB subband audio data portions over the plurality of ERB subbands in the ERB domain.

In some embodiments, as a part of estimating peak powers (e.g., presence of voice activities in subband portions in a given time window, onsets of non-noise sound activities or bursts of signal energy in subband portions in a given time window, etc.), the peak estimation operations (e.g., 206-1, 206-*i*, 206-I', etc.) may comprise performing smoothing operations on banded subband powers (e.g., directly) derived from audio data (e.g., banded amplitudes, etc.) in subband portions in a time domain such as represented by the sequence of time windows, etc. In a non-limiting implementation example, the peak estimation operations (e.g., 206-1, 206-*i*, 206-I', etc.) may be based (e.g., entirely, at least in part, etc.) on values computed from a current time window (e.g., the n-th time window, etc.) and values computed from a previous time window (e.g., the (n−1)-th time window, etc.) immediately preceding the current time window in a sequence of time windows used in the analysis filterbank operations (e.g., 202-1, 202-*i*, 202-I', etc.).

In some embodiments, the subband integrator (102) comprises software, hardware, a combination of software and hardware, etc., configured to perform two or more spectral smoothing operations (e.g., 210-1, 210-*i*, 210-I', etc.). The two or more spectral smoothing operations (e.g., 210-1, 210-*i*, 210-I', etc.) may be configured to operate in parallel, in series, partly in parallel partly in series, etc., to generate smoothed spectral powers by performing spectral smoothing on estimated peak powers (e.g., as derived in the peak estimation operations, etc.) for subband portions in the two or more pluralities of ERB subband audio data portions over the plurality of ERB subbands in the ERB domain. For example, a spectral smoothing operation (e.g., 210-*i*, etc.) may be configured to operate in parallel, in series, partly in parallel partly in series, etc., with other spectral smoothing operations (e.g., 210-1, 210-I', etc.) to generate a smoothed spectral power by performing spectral smoothing on an estimated peak power for each subband portion in an i-th plurality of subband portions of the two or more pluralities of ERB subband audio data portions over the plurality of ERB subbands in the ERB domain.

In some embodiments, as a part of obtaining smoothed spectral powers, the spectral smoothing operations (e.g., 210-1, 210-*i*, 210-I', etc.) may comprise performing smoothing operations on estimated peak powers in subband portions in a spectral domain such as represented the plurality of ERB subbands, etc. In a non-limiting implementation example, the spectral smoothing operations (e.g., 210-1, 210-*i*, 210-I', etc.) performed with respect to an estimated peak power of a specific (e.g., ERB, etc.) subband portion may be based (e.g., entirely, at least in part, etc.) on values computed from the specific subband portion (e.g., the k-th subband portion, etc.) and values computed from one or more other subband portions (e.g., neighboring subband portions, one or more subband portions within a spectral window, etc.).

4. Peak Power Tracker

Figure 3:
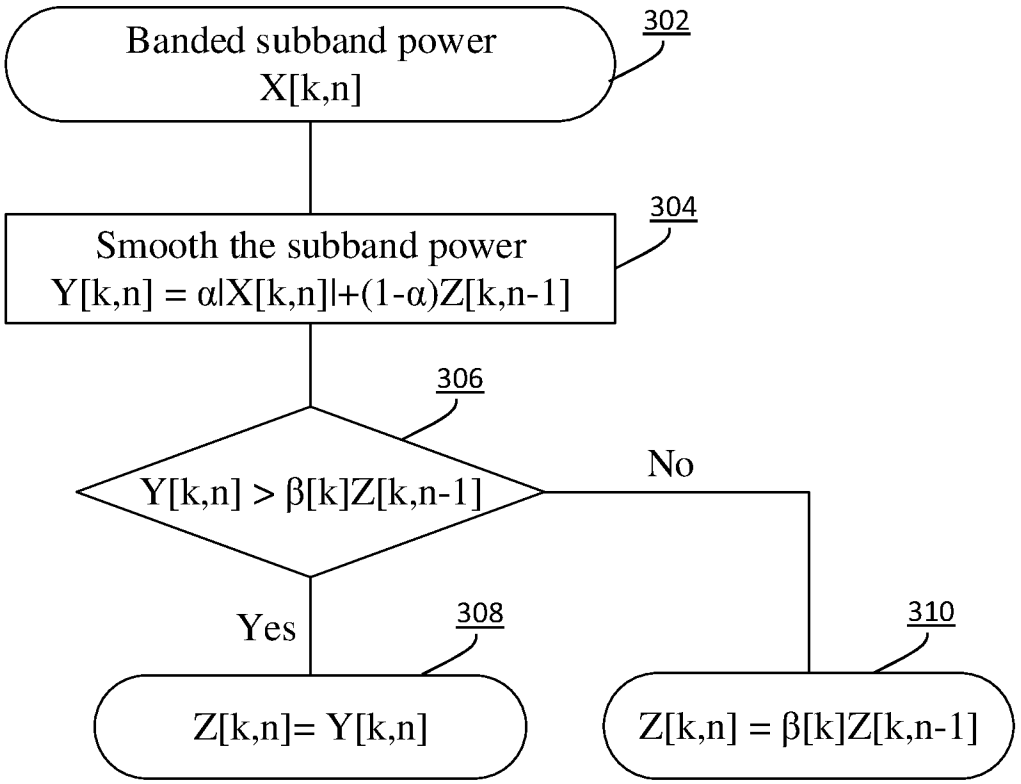
FIG. 3 illustrates an algorithm for an example leaky peak power tracker.

FIG. 3 illustrates an algorithm for an example leaky peak power tracker that may be implemented in a peak estimation operation (e.g., 206-1, 206-*i*, 206-I', etc.) as described herein for the purpose of estimating a peak power of a subband portion. In some embodiments, the leaky peak power tracker is configured to get a good estimate of a relatively clean signal in ERB domain by emphasizing direct sounds (e.g., utterance, onsets, attacks, etc.) in speech components in ERB-based subband (e.g., by deemphasizing indirect sounds such as reverberations of utterance, etc.).

In some embodiments, banded peak powers may be estimated based on values computed from a current time window and from a limited number (e.g., one, two, etc.) of time windows immediately preceding the current time window. Thus, an estimate peak power for a subband portion as described herein can be obtained relatively timely within a relatively short time. In block 302, the leaky peak power tracker computes, based on audio data in a subband portion indexed by a subband index k and a time window index n, a banded subband power X[k, n] for the subband portion. The subband portion may be the k-th subband portion in a plurality of subband portions of the two or more pluralities of ERB subband audio data portions over the plurality of ERB subbands in the ERB domain in the n-th time window.

In block 304, the leaky peak power tracker computes, based on a smoothing factor α, the banded subband power X[k, n] for the subband portion and a previous estimated peak power Z[k, n−1], a smoothed subband power Y[k, n] for the subband portion. The previous estimated peak power Z[k, n−1] represents an estimated peak power for a subband portion that is the k-th subband portion in a plurality of subband portions of the two or more pluralities of ERB subband audio data portions over the plurality of ERB subbands in the ERB domain in the (n−1)-th time window immediately preceding the n-th time window.

In various embodiments, the smoothing factor α may be set to a value in the range of 20 milliseconds to 200 milliseconds, or set in relation to the size of a time window such as 2×, 3×, 4×, etc., of the time window (e.g., 10 milliseconds, 20 milliseconds, etc.). In some embodiments, the smoothing factor α may be specifically selected not to overly suppress voices in subband portions and introduce distortions and artifacts.

In block 306, the leaky peak power tracker determines whether the smoothed subband power Y[k, n] for the k-th subband portion in the n-th time window exceeds a product of an asymmetric decay factor β[k] multiplied with the previous estimated peak power Z[k, n−1] for the k-th subband portion in the (n−1)-th time window.

In various embodiments, the asymmetric decay factor β[k] may be set to a value in the range of 200 milliseconds to 3 seconds. The asymmetric decay factor β[k] may or may not be set to a constant value across some or all of subband portions. Settings of the asymmetric decay factor β[k] may depend on environments (e.g., wall reflectance properties, spatial sizes, etc.) in which multiple microphones as described herein are deployed to capture voices. The asymmetric decay factor β[k] may be set to relatively high values (e.g., 2½ seconds, etc.) for relatively highly reverberated environments, and to less values (e.g., 1 second, etc.) for less reverberated environments.

In some embodiments, the asymmetric decay factor β[k] may be set to a constant value for a subband portion (or the k-th subband portion) to which the value of the asymmetric decay factor β[k] is to be applied, but varies with the center frequency of the subband portion (or the k-th subband portion). For example, to better match the reverberation tail (e.g., relatively large reverberation at low frequencies, etc.) of a typical conference room, the asymmetric decay factor β[k] may increase in value as the center frequency of the subband portion (or the k-th subband portion) decreases.

In some embodiments, a reverberation parameter such as $RT_{60}$, etc., at a spatial location where the microphones are deployed may be measured or estimated. For example, a device as described herein may emit reference audible signals and measure a reverberation parameter such as reverberation times, etc., in the spatial location. The decay factor β[k] for various subband portions or various frequency regions may be set, depending on the value of the reverberation parameter as determined or estimated for the spatial location.

In some embodiments, for simplicity, values of the asymmetric decay factor β[k] can be divided into two regions. A much longer decay constant (e.g., 1.5 second, etc.) may be used with the asymmetric decay factor β[k] for subband portions with center frequencies below a threshold frequency (e.g., 300 Hz, etc.), whereas a relatively short decay constants (e.g., 600 milliseconds, etc.) may be used with the asymmetric decay factor β[k] for subband portions above the threshold frequency.

In block 308, in response to determining that the smoothed subband power Y[k, n] for the k-th subband portion in the n-th time window exceeds a product of a decay factor β multiplied with the previous estimated peak power Z[k, n−1] for the k-th subband portion in the (n−1)-th time window, the leaky peak power tracker sets an estimated peak power Z[k, n] for the k-th subband portion in the n-th time window to the smoothed subband power Y[k, n] for the k-th subband portion in the n-th time window.

In block 310, in response to determining that the smoothed subband power Y[k, n] for the k-th subband portion in the n-th time window does not exceed a product of a decay factor β multiplied with the previous estimated peak power Z[k, n−1] for the k-th subband portion in the (n−1)-th time window, the leaky peak power tracker sets an estimated peak power Z[k, n] for the k-th subband portion in the n-th time window to the decay factor β multiplied with the previous estimated peak power Z[k, n−1] for the k-th subband portion in the (n−1)-th time window.

For the purpose of illustration, a smoothing filter combined with a decay factor may be used to estimate a banded peak power of a subband portion as described herein. It should be noted that banded peak powers may be estimated by other methods, other filters, etc., in various other embodiments.

5. Spectral Smoothing of Peak Powers

Figure 4:
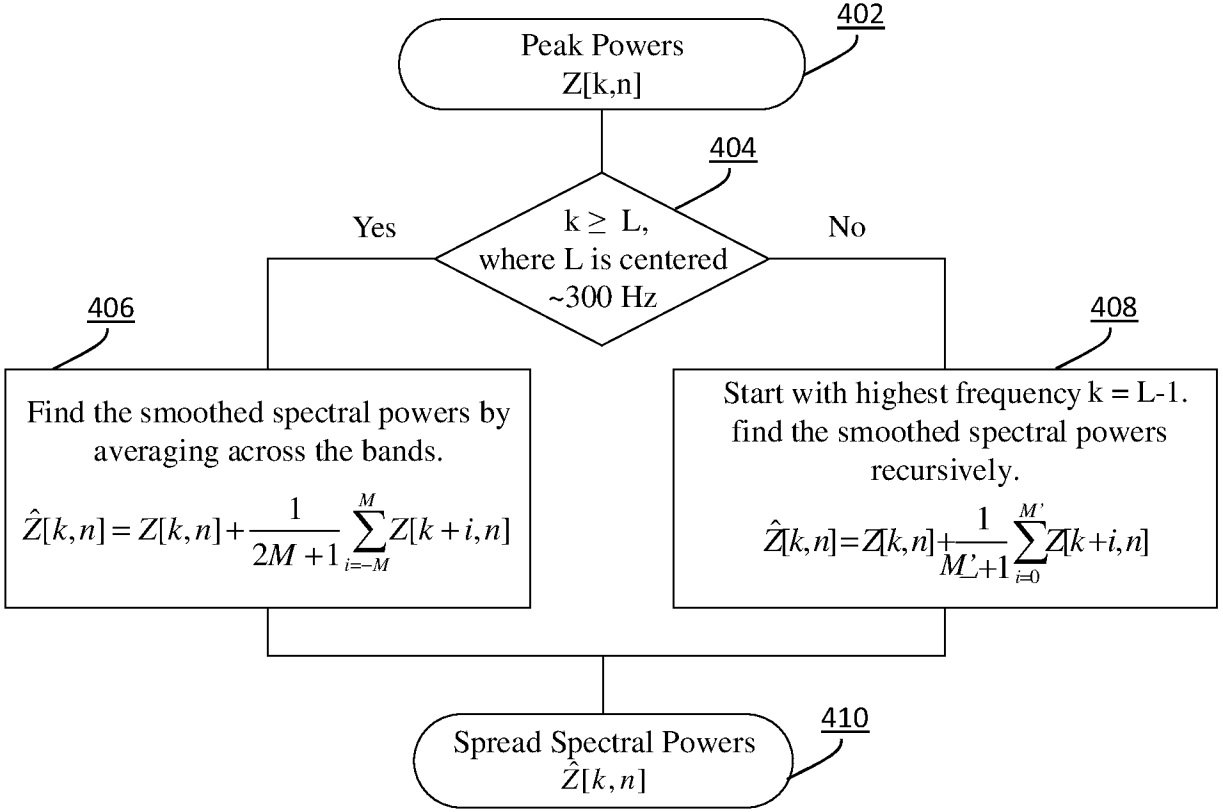
FIG. 4 illustrates an algorithm for spectral smoothing.

FIG. 4 illustrates an algorithm for spectral smoothing that may be implemented in a spectral smoothing operation (e.g., 210-*i*, etc.) as described herein. The algorithm can be used to obtain smoothed spectral powers of subband portions in a plurality of subband portions (e.g., the i-th plurality of subband portions generated by the i-th forward banding operation 204-*i*, etc.) originated from a microphone signal (e.g., the i-th microphone signal, etc.). The algorithm for spectral smoothing spreads a subband peak power across multiple subband bands to get a relatively stable estimate of direct sound (e.g., utterance, onsets, attacks, etc.) in speech components of a microphone signal.

In block 402, the spectral smoothing operation (e.g., 210-*i*, etc.) receives estimated peak powers Z[k, n] for a subband portion indexed by a subband index k and a time window index n. The subband portion may be the k-th subband portion in a plurality of subband portions of the two or more pluralities of ERB subband audio data portions over the plurality of ERB subbands in the ERB domain in the n-th time window.

Relatively low frequency spatial pressure waves (or sound waves) may have more pronounced standing wave influences than relatively high frequency spatial pressure waves. As a result, accuracies in peak powers computed or estimated for relatively low frequency subband portions may be relatively low as compared with accuracies peak powers computed or estimated for relatively high frequency subband portions. In some embodiments, the spectral smoothing operation (e.g., 210-*i*, etc.) may perform spectral smoothing differently on subband portions with center frequencies at or above a cutoff frequency from on other subband portions with center frequencies below the cutoff frequency. Examples of a cutoff frequency may include, but are not limited to only, any of: 250 Hz, 300 Hz, 350 Hz, 400 Hz, 450 Hz, frequencies estimated based on spatial dimensions of a reference spatial location, a specific spatial location, a frequency such as 200 Hz at which relatively prominent standing wave effects occurs plus a frequency safety such as 100 Hz, etc.

In a non-limiting implementation example, smoothed spectral powers for subband portions with center frequencies at or above a cutoff frequency are first computed (in any order of the subband portions with the center frequencies at or above the cutoff frequency) based on estimated peak powers (e.g., from Z[k−M, n] of (k−M)-th subband portion to Z[k+M, n] of (k+M)-th subband portion where M is a positive integer, etc.) in spectral windows comprising a certain number of subband portions.

Smoothed spectral powers for subband portions with center frequencies below the cutoff frequency are then computed recursively, or in the order from a subband portion with the highest center frequency below the cutoff frequency to a subband portion with the lowest center frequency below the cutoff frequency. For example, a smoothed spectral power for a subband portion with a center frequency below the cutoff frequency may be computed based on powers in a spectral window comprising a certain number of subband portions having center frequencies above the subband portion's center frequency. The powers in the spectral window may comprise estimated peak powers for subband portions in the spectral window if these subband portions have center frequencies no less than the cutoff frequency. The powers in the spectral window may comprise smoothed spectral powers for subband portions in the spectral window if these subband portions have center frequencies less than the cutoff frequency.

In block 404, the spectral smoothing operation (e.g., 210-*i*, etc.) determines whether the k-th subband portion of which the estimated peak power is Z[k, n] is centered at, or has, a center frequency no less than the cutoff frequency. In some embodiments, a reference subband portion, denoted as the L-th subband portion, is centered at the cutoff frequency.

In block 406, in response to determining that the k-th subband portion is centered at, or has, a center frequency no less than the cutoff frequency, the spectral smoothing operation (e.g., 210-*i*, etc.) computes a smoothed spectral power for the k-th subband portion based on estimated peak powers (e.g., from Z[k−M, n] of (k−M)-th subband portion to Z[k+M, n] of (k+M)-th subband portion, etc.) in a spectral window comprising a certain number (e.g., 2, 3, 4, 5+, a positive integer M plus one, etc.) of subband portions (e.g., from (k−M)-th subband portion to (k+M)-th subband portion, etc.).

In block 408, in response to determining that the k-th subband portion is centered at, or has, a center frequency less than the cutoff frequency, the spectral smoothing operation (e.g., 210-*i*, etc.) computes smoothed spectral powers for subband portions with center frequencies below the cutoff frequency recursively, or in the order from the highest center frequency subband portion to the lowest center frequency subband portion.

For example, a first smoothed spectral power for the (L−1)-th subband portion (or the k-th subband portion where k=L−1) with a center frequency below the cutoff frequency is first computed based on first powers in a first spectral window comprising a certain number (e.g., 2, 3, 4, 5+, a positive integer M' plus one, etc.) of subband portions (e.g., from (L−1)-th subband portion to (M'+L−1)-th subband portion, etc.). Here, the first powers in the first spectral window may comprise estimated peak powers in (L−1)-th to (M'+L−1)-th subband portions.

A second smoothed spectral power for the (L−2)-th subband portion (or the k-th subband portion where k=L−2) with a center frequency below the cutoff frequency is next computed based on second powers in a second spectral window comprising the certain number of subband portions (e.g., from (L−2)-th subband portion to (M'+L−2)-th subband portion, etc.). Here, the second powers in the second spectral window may comprise estimated peak powers in (L−2)-th and L-th to (M'+L−2)-th subband portions, and the first smoothed spectral power in the (L−1)-th subband window.

A third smoothed spectral power for the (L−3)-th subband portion (or the k-th subband portion where k=L−3) with a center frequency below the cutoff frequency is computed, after the second smoothed spectral power is computed, based on third powers in a third spectral window comprising the certain number of subband portions (e.g., from (L−3)-th subband portion to (M'+L−3)-th subband portion, etc.). Here, the third powers in the third spectral window may comprise estimated peak powers in (L−3)-th and L-th to (M'+L−3)-th subband portions, the first smoothed spectral power in the (L−1)-th subband window, and the second smoothed spectral power in the (L−2)-th subband window. This recursive process may be repeated until smoothed spectral powers for all the subband portions having center frequencies below the cutoff frequency are computed.

In block 410, the spectral smoothing operation (e.g., 210-*i*, etc.) outputs the smoothed spectral powers for the plurality (e.g., the i-th plurality, etc.) of subband portions to the next operation such as a weight calculation 212, etc.

Referring now to FIG. 2, in some embodiments, the subband integrator (102) comprises software, hardware, a combination of software and hardware, etc., configured to perform the weight calculation (212). The weight calculation (212) may be configured to receive, from the two or more spectral smoothing operations (e.g., 210-1, 210-*i*, 210-I', etc.), the smoothed spectral powers for the subband portions in the two or more pluralities of ERB subband audio data portions over the plurality of ERB subbands in the ERB domain. The received smoothed spectral powers comprise a smoothed spectral power (or a smoothed power spectrum) for each subband portion in each plurality of subband portions of the two or more pluralities of ERB subband audio data portions over the plurality of ERB subbands in the ERB domain.

Additionally, optionally, or alternatively, the weight calculation (212) may be configured to receive, from the two or more noise floor estimation operations (e.g., 208-1, 208-*i*, 208-I', etc.), the noise floors for the subband portions in the two or more pluralities of ERB subband audio data portions over the plurality of ERB subbands in the ERB domain. The received noise floors comprise a noise floor for each subband portion in each plurality of subband portions of the two or more pluralities of ERB subband audio data portions over the plurality of ERB subbands in the ERB domain.

In some embodiments, the weight calculation (212) is further configured to compute weights $W_i[k, n]$ that can be used to linearly combine subband portions in a subband and in a time window that are respectively originated from the two or more microphone signals (e.g., 106-1, 106-*i*, 106-I', etc.) into an integrated subband portion for the same subband and for the same time window. These weights is configured to maximize direct sound in the subband portions, and can be computed as functions of smoothed power spectrums as represented by the smoothed spectral powers $\hat{Z}_i[k, n]$ and of the noise floors $\hat{N}_i[k, n]$ for microphone i, the k-th subband, and the n-th time window, as follows:

$$Z_i'[k, n] = \hat{Z}_i[k, n] + \frac{1}{N - L + 1}\sum_{j=L}^{N}\hat{Z}_i[k + j, n] \quad (1)$$

$$N_i'[k, n] = \hat{N}_i[k, n] + \frac{1}{N - L + 1}\sum_{j=L}^{N}\hat{N}_i[k + j, n] \quad (2)$$

$$W_i[k, n] = \frac{\max(Z_i'[k, n], \max_{all\ j, j\neq i} N_j'[k, n])}{\sum_{all\ t}\max(Z_t'[k, n], \max_{all\ j, j\neq t} N_j'[k, n])} \quad (3)$$

where "$\Sigma_{all\ t}$ . . . " sums over all of the two or more microphone signals (e.g., 106-1, **106-*i*, 106-I'**, etc.) and may be used to normalize the weights as shown in expression (3).

In ideal scenarios in which there is no or little noise in subband portions, speech activities are maximized as those subband portions with relatively high values in the measures of powers are assigned higher weights and thus amplified more than other subband portions.

In scenarios where there are two simultaneous talkers with their strongest powers in different frequency bands or ERB bands, speeches from both talkers are enhanced or maximized under the techniques as described herein.

In scenarios where there are two simultaneous talkers with their strongest powers overlapping in largely the same frequency bands or ERB bands, if the talkers generate similar levels in smoothed spectral powers, speeches from both talkers are similarly enhanced or maximized under the techniques as described herein.

On the other hand, in scenarios where there are two simultaneous talkers with their strongest powers overlapping in largely the same frequency bands or ERB bands, if one talker generates higher levels in smoothed spectral powers than the other talkers, speeches from the former talker are maximized while speeches from the latter talker are suppressed or masked under the techniques as described herein. This is a desirable effect in cross talk situations, as the former talker may represent the main speaker whose speech activities should be amplified in the first place.

Under other approaches such as full-band mixing algorithms, noise floors go up after multiple microphone signals are combined, even when there is no or little speech activity in many subbands in a time window. In contrast, the weights assigned under techniques as described herein are configured to avoid raising noise floors in subband portions and in the overall integrated signal, regardless of whether there is speech activity in a subband in a time window. The weights emphasize on subband portions of a microphone signal in which speech activities are detected (e.g., by determining that the measures of powers are above noise floors in other microphone signals, etc.), and at the same time deemphasize subband portions of other microphone signals that comprise relatively large noise components.

In some embodiments, the subband integrator (102) comprises software, hardware, a combination of software and hardware, etc., configured to perform an inverse banding operation 214. The inverse banding operation (214) may be configured to receive weights $W_i[k, n]$ for linearly combining (e.g., ERB, etc.) subband portions in each subband in the plurality of ERB subbands in the ERB domain, to generate, based on the weights $W_i[k, n]$, weights $\hat{W}_i[m, n]$ that can be used to combine frequency domain audio data portions in each frequency subband (e.g., the m-th frequency band, etc.) in a plurality of (e.g., constant-sized, etc.) frequency subbands in the n-th time window in each microphone signal (e.g., **106-*i*, etc.) in the microphone signals (e.g., 106-1, 106-*i*, 106-I'**, etc.), etc.

In some embodiments, the subband integrator (102) comprises software, hardware, a combination of software and hardware, etc., configured to perform to a weight application operation 216. The weight application operation (216) may be configured to generate a plurality of weighted frequency audio data portions each of which corresponds to a frequency subband over the plurality of frequency subbands by applying the weights $\hat{W}_i[m, n]$ to each frequency subband (e.g., the m-th frequency band, etc.) in the plurality of frequency subbands in the n-th time window in each microphone signal (e.g., **106-*i***, etc.) in the microphone signals.

In some embodiments, the subband integrator (102) comprises software, hardware, a combination of software and hardware, etc., configured to perform a synthesis filterbank operation 218. The synthesis filterbank operation (218) may be configured to synthesize the plurality of weighted frequency audio data portions over the plurality of frequency subbands into an integrated (e.g., audio, etc.) signal (e.g., 108-1 of FIG. 1A, etc.) in a time domain.

6. Reference and Auxiliary Microphone Signals

In some embodiments, two or more microphone signals (e.g., 106-1, **106-*i*, 106-I', etc.) as illustrated in FIG. 2 may comprise a reference microphone signal (e.g., 106-W of FIG. 1B, etc.) generated by a reference microphone (e.g., 104-W of FIG. 1B, etc.) and one or more (e.g., auxiliary, non-reference, etc.) microphone signals (e.g., 106-1 through 106-I of FIG. 1B, etc.) generated by one or more other (e.g., auxiliary, non-reference, etc.) microphones (e.g., 104-1 through 104-I of FIG. 1**B, etc.). For simplicity, the one or more (e.g., auxiliary, non-reference, etc.) microphones may be denoted as one or more auxiliary microphones, and the one or more (e.g., auxiliary, non-reference, etc.) microphone signals may be denoted as one or more auxiliary microphone signals.

The weight calculation (212) may be configured to receive, from one or more spectral smoothing operations (e.g., 210-1, **210-*i*, etc.), smoothed spectral powers $\hat{Z}_i[k,n]$ and noise floors $\hat{N}_i[k, n]$ for each microphone i (where i is a microphone index for microphones 104-1 through 104-I) in the one or more auxiliary microphones, the k-th subband over the plurality of ERB subbands in the ERB domain, and the n-th time window. In addition, the weight calculation (212) may be configured to receive, from a spectral smoothing operation (e.g., 210-I'**, etc.), smoothed spectral powers $\hat{Z}_w[k, n]$ and of the noise floors $\hat{N}_w[k, n]$ for the reference microphone (where W is the microphone index for the reference microphone), the k-th subband over the plurality of ERB subbands in the ERB domain, and the n-th time window.

In some embodiments, the weight calculation (212) is further configured to form one or more pairs of microphone signals with each pair of microphone signals comprising one of the one or more auxiliary microphone signals (e.g., 106-1, **106-*i*, 106-I, etc.) and the reference microphone signal (106**-W).

For each pair of microphone signals in the one or more pairs of microphone signals, the weight calculation (212) may compute a pair of weights comprising a weight $W_i[k, n]$ for the auxiliary microphone signal (e.g., **106-*i*, etc.) and a weight $W_W[k, n]$ for the reference microphone signal (106**-W) without considering other auxiliary microphone signals in the other pairs of microphone signals in the one or more pairs of microphone signals. The computation of the pair of weights for each pair of microphone signals is substantially similar to the computation of weights in the scenarios in which a plurality of microphones comprises no reference microphone, as follows:

$$Z_i'[k, n] = \hat{Z}_i[k, n] + \frac{1}{N-L+1}\sum_{j=L}^{N}\hat{Z}_i[k+j, n] \tag{4}$$

$$Z_W'[k, n] = \hat{Z}_W[k, n] + \frac{1}{N-L+1}\sum_{j=L}^{N}\hat{Z}_W[k+j, n] \tag{5}$$

$$N_i'[k, n] = \hat{N}_i[k, n] + \frac{1}{N-L+1}\sum_{j=L}^{N}\hat{N}_i[k+j, n] \tag{6}$$

$$N_W'[k, n] = \hat{N}_W[k, n] + \frac{1}{N-L+1}\sum_{j=L}^{N}\hat{N}_W[k+j, n] \tag{7}$$

$$W_i[k, n] = \frac{\max(Z_i'[k, n], N_W'[k, n])}{\max(Z_i'[k, n], N_W'[k, n]) + \max(Z_W'[k, n], N_i'[k, n])} \tag{8}$$

$$W_W[k, n] = \min_{\forall i}\, 1 - W_i[k, n], \text{ where } i \text{ indexes the auxiliary mics} \tag{9}$$

The computation represented by expressions (5) through (9) may be repeated for all pairs in the one or more pairs of microphone signals for the purpose of obtaining the weights $W_i[k, n]$ for all the auxiliary microphone signals (e.g., 106-1 through 106-I, etc.) and the weights $W_W[k, n]$ for the reference microphone signal (106-W). In some embodiments, these weights $W_i[k, n]$ and $W_W[k, n]$ may be normalized to a fixed value such as one (1).

In some embodiments, the inverse banding operation (214) may be configured to receive weights $W_i[k, n]$ and $W_W[k, n]$ for linearly combining (e.g., ERB, etc.) subband portions in each subband in the plurality of ERB subbands in the ERB domain, to generate, based on the weights $W_i[k, n]$ and $W_W[k, n]$, weights $\hat{W}_i[m, n]$ and $\hat{W}_w[m, n]$ that can be used to combine frequency domain audio data portions in each frequency subband (e.g., the m-th frequency band, etc.) in a plurality of (e.g., constant-sized, etc.) frequency subbands in the n-th time window in each microphone signal in the reference and auxiliary microphone signals (e.g., 106-1, **106-*i*, 106-I, 106**-W, etc.), etc.

In some embodiments, the weight application operation (216) may be configured to generate a plurality of weighted frequency audio data portions each of which corresponds to a frequency subband over the plurality of frequency subbands by applying the weights $\hat{W}_i[m, n]$ and $\hat{W}_w[m, n]$ to each frequency subband (e.g., the m-th frequency band, etc.) in the plurality of frequency subbands in the n-th time window in each microphone signal in the reference and auxiliary microphone signals (e.g., 106-1, **106-*i*, 106-I, 106**-W, etc.).

In some embodiments, the synthesis filterbank operation (218) may be configured to synthesize the plurality of weighted frequency audio data portions over the plurality of frequency subbands into an integrated (e.g., audio, etc.) signal (e.g., 108-2 of FIG. 1B, etc.) in a time domain.

Some operations as described herein have been described as being performed with constant-sized frequency bands or ERB subbands, etc. It should be noted that in various embodiments, the operations that have been described as performed with ERB subbands may be similarly performed with constant-sized frequency bands. Also, it should be noted that in various embodiments, these operations may be similarly performed in other domains bands such as time domain, a time-frequency domain, a transform domain that can be transformed from a time domain, etc., or for other frequency-dependent bands other than ERB subbands and constant-sized frequency bands.

7. Example Process Flows

Figure 5:
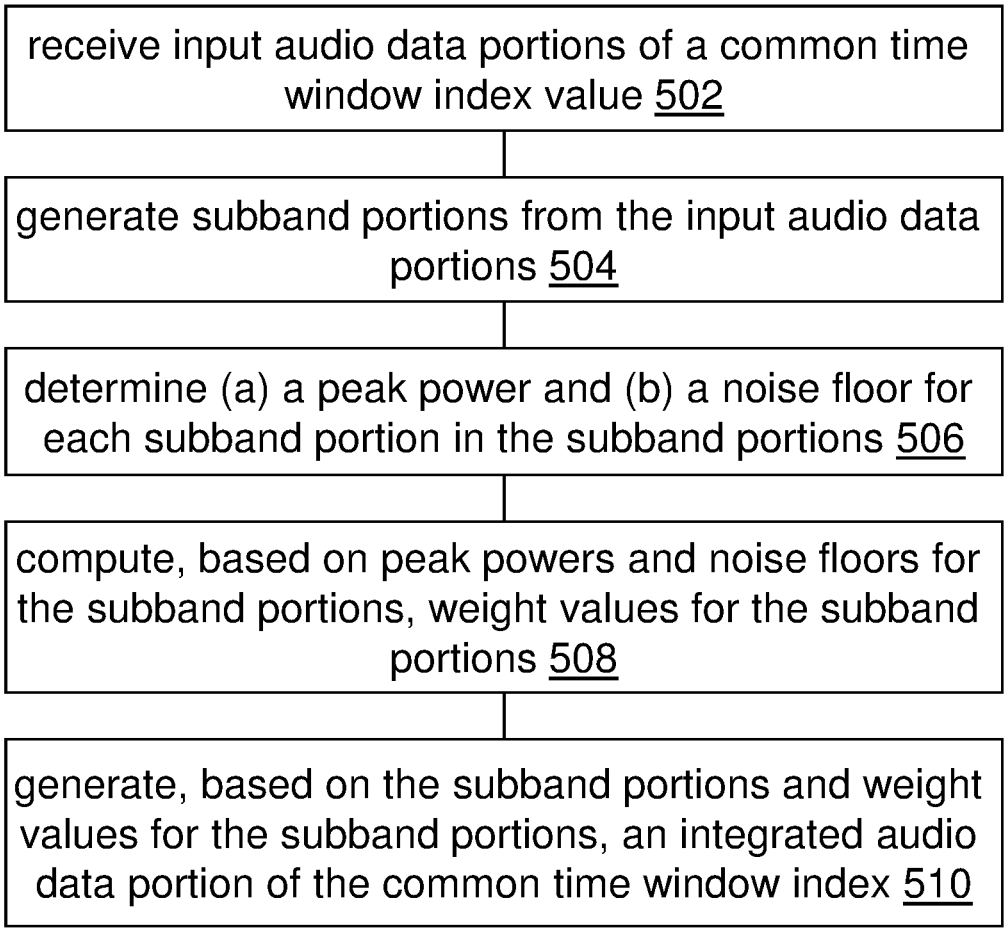
FIG. 5 illustrates an example process flow.

FIG. 5 illustrates an example process flow. In some embodiments, one or more computing devices or components (e.g., a subband integrator 102 of FIG. 1A, FIG. 1B or FIG. 2, etc.) may perform this process flow. In block 502, the subband integrator (102) receives two or more input audio data portions of a common time window index value, the two or more input audio data portions being respectively generated based on responses of two or more microphones to sounds occurring at a location.

In block 504, the subband integrator (102) generates two or more pluralities of subband portions from the two or more input audio data portions, each plurality of subband portions in the two or more pluralities of subband portions corresponding to a respective input audio data portion of the two or more input audio data portions.

In block 506, the subband integrator (102) determines (a) a peak power and (b) a noise floor for each subband portion in each plurality of subband portions in the two or more pluralities of subband portions, thereby determining a plurality of peak powers and a plurality of noise floors for the plurality of subband portions.

In block 508, the subband integrator (102) computes, based on a plurality of peak powers and a plurality of noise floors for each plurality of subband portions in the two or more pluralities of subband portions, a plurality of weight values for the plurality of subband portions, thereby computing two or more pluralities of weight values for the two or more pluralities of subband portions.

In block 510, the subband integrator (102) generates, based on the two or more pluralities of subband portions and two or more pluralities of weight values for the two or more pluralities of subband portions, an integrated audio data portion of the common time window index.

In an embodiment, each of the two or more input audio data portions comprises frequency domain data in a time window indexed by the common time window index.

In an embodiment, the two or more microphones comprise a reference microphone for which weight values are calculated differently from how other weight values for other microphones of the two or more microphones are calculated.

In an embodiment, the two or more microphones are free of a reference microphone for which weight values are calculated differently from how other weight values for other microphones of the two or more microphones are calculated.

In an embodiment, an individual subband portion in a plurality of subband portions in the two or more pluralities of subband portions corresponds to an individual audio frequency band in a plurality of audio frequency bands spanning across an overall audio frequency range. In an embodiment, the plurality of audio frequency bands represents a plurality of equivalent rectangular bandwidth (ERB) bands. In an embodiment, the plurality of audio frequency bands represents a plurality of linearly spaced frequency bands.

In an embodiment, the peak power is determined from a smoothened banded power of a corresponding subband portion.

In an embodiment, the smoothened banded power is determined based on a smoothing filter with a smoothing time constant ranging between 20 milliseconds and 200 milliseconds and a decay time constant ranging between 1 second and 3 seconds.

In an embodiment, the two or more microphones comprise at least one of soundfield microphones or mono microphones.

In an embodiment, the subband integrator (102) is further configured to compute a plurality of spread spectral power levels from the plurality of peak powers.

In an embodiment, the plurality of spread spectral power level comprises two or more spread spectral power levels computed recursively for two or more subband portions corresponding to two or more audio frequency bands that are below a cutoff frequency.

In an embodiment, the two or more pluralities of weight values are collectively normalized to a fixed value.

In an embodiment, the two or more pluralities of weight values comprise individual weight values for subband portions all of which correspond to a specific equivalent rectangular bandwidth (ERB) band; the individual weight values for the subband portions are normalized to one.

In an embodiment, the individual weight values for the subband portions comprises a weight value for one of the subband portions; the subband integrator (102) is further configured to determine, based at least in part on the weight value for the one of the subband portions, one or more weight values for one or more constant-sized subband portions in two or more pluralities of constant-sized subband portions for the two or more input audio data portions. In an embodiment, a weight value for a subband portion related to a microphone is proportional to the larger of a spectral spread peak power level of the microphone or a maximum noise floor among all other microphones.

In an embodiment, a weight value for a subband portion related to a non-reference microphone in the two or more microphones is proportional to the larger of a spectral spread peak power level of the non-reference microphone or a noise floor of a reference microphone in the two or more microphones.

In an embodiment, each input audio data portion of the two or more input audio data portions of the common time window index value is derived from an input signal generated by a respective microphone of the two or more microphones at the location; the input signal comprises a sequence of input audio data portions of a sequence of time window indexes; the sequence of input audio data portions includes the input audio data portion; the sequence of time window indexes includes the common time window index.

In an embodiment, the subband integrator (102) is further configured to generate an integrated signal with a sequence of integrated audio data portions of a sequence of time window indexes; the sequence of integrated audio data portions includes the integrated audio data portion; the sequence of time window indexes includes the common time window index.

In an embodiment, the subband integrator (102) is further configured to integrate the integrated signal within a soundfield audio signal.

In various example embodiments, a system, an apparatus, or one or more other computing devices may be used to implement at least some of the techniques as described including but not limited to a method, a control, a function, a feature, etc., as described herein. In an embodiment, a non-transitory computer readable storage medium stores software instructions, which when executed by one or more processors cause performance of a method, a control, a function, a feature, etc., as described herein.

Note that, although separate embodiments are discussed herein, any combination of embodiments and/or partial embodiments discussed herein may be combined to form further embodiments.

8. Implementation Mechanisms—Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 6:
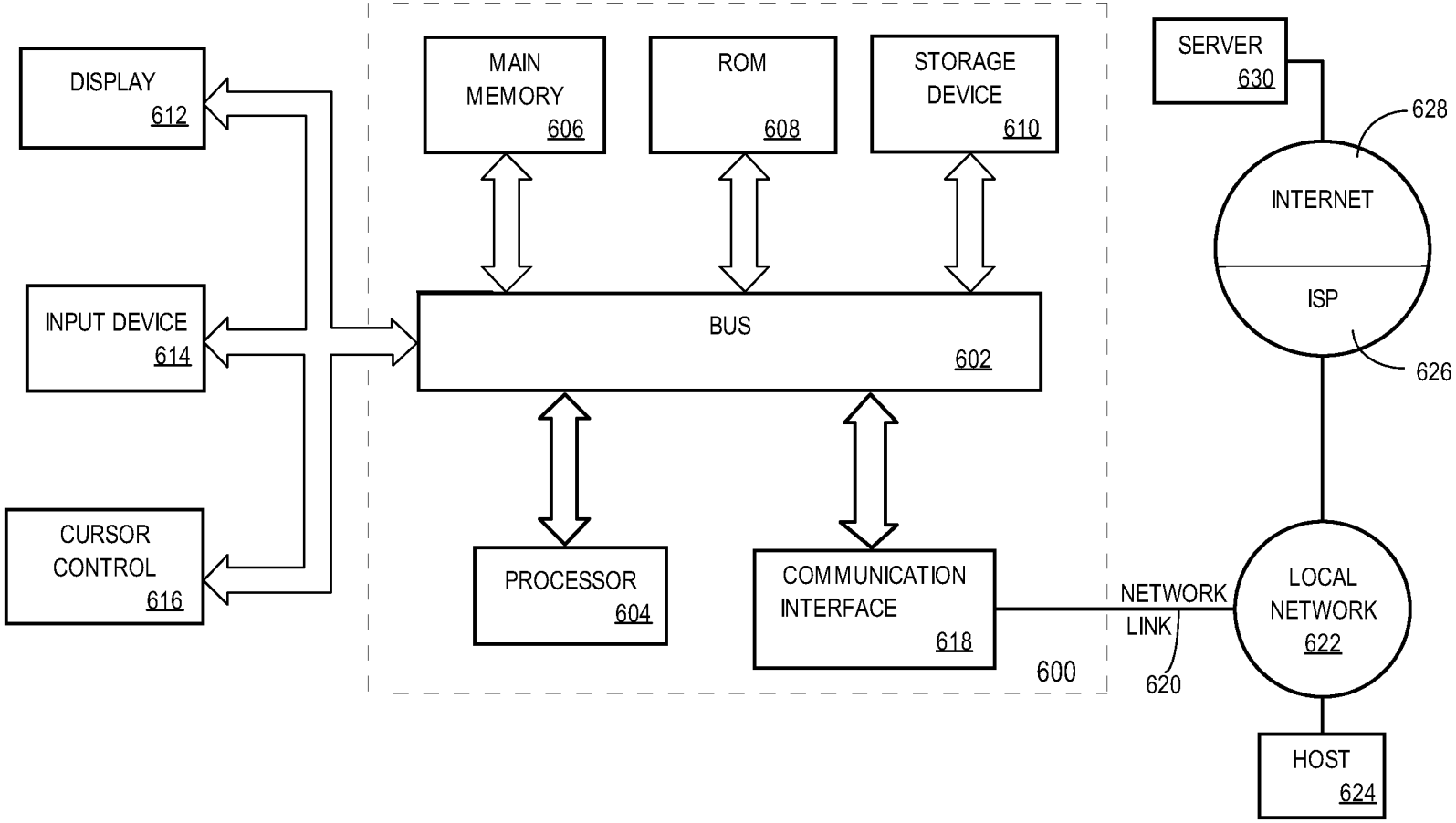
FIG. 6 illustrates an example hardware platform on which a computer or a computing device as described herein may be implemented.

For example, FIG. 6 is a block diagram that illustrates a computer system 600 upon which an example embodiment of the invention may be implemented. Computer system 600 includes a bus 602 or other communication mechanism for communicating information, and a hardware processor 604 coupled with bus 602 for processing information. Hardware processor 604 may be, for example, a general purpose microprocessor.

Computer system 600 also includes a main memory 606, such as a random access memory (RAM) or other dynamic storage device, coupled to bus 602 for storing information and instructions to be executed by processor 604. Main memory 606 also may be used for storing temporary variables or other intermediate information during execution of instructions to be executed by processor 604. Such instructions, when stored in non-transitory storage media accessible to processor 604, render computer system 600 into a special-purpose machine that is customized to perform the operations specified in the instructions.

Computer system 600 further includes a read only memory (ROM) 608 or other static storage device coupled to bus 602 for storing static information and instructions for processor 604. A storage device 610, such as a magnetic disk or optical disk, is provided and coupled to bus 602 for storing information and instructions.

Computer system 600 may be coupled via bus 602 to a display 612, such as a liquid crystal display, for displaying information to a computer user. An input device 614, including alphanumeric and other keys, is coupled to bus 602 for communicating information and command selections to processor 604. Another type of user input device is cursor control 616, such as a mouse, a trackball, touchscreen, or cursor direction keys for communicating direction information and command selections to processor 604 and for controlling cursor movement on display 612. This input device typically has two degrees of freedom in two axes, a first axis (e.g., x) and a second axis (e.g., y), that allows the device to specify positions in a plane.

Computer system 600 may implement the techniques described herein using customized hard-wired logic, one or more ASICs or FPGAs, firmware and/or program logic which in combination with the computer system causes or programs computer system 600 to be a special-purpose machine. According to one embodiment, the techniques herein are performed by computer system 600 in response to processor 604 executing one or more sequences of one or more instructions contained in main memory 606. Such instructions may be read into main memory 606 from another storage medium, such as storage device 610. Execution of the sequences of instructions contained in main memory 606 causes processor 604 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 610. Volatile media includes dynamic memory, such as main memory 606. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 602. Transmission media can also take the form of acoustic or light waves, such as those generated during radio-wave and infra-red data communications.

Various forms of media may be involved in carrying one or more sequences of one or more instructions to processor 604 for execution. For example, the instructions may initially be carried on a magnetic disk or solid state drive of a remote computer. The remote computer can load the instructions into its dynamic memory and send the instructions over a telephone line using a modem. A modem local to computer system 600 can receive the data on the telephone line and use an infra-red transmitter to convert the data to an infra-red signal. An infra-red detector can receive the data carried in the infra-red signal and appropriate circuitry can place the data on bus 602. Bus 602 carries the data to main memory 606, from which processor 604 retrieves and executes the instructions. The instructions received by main memory 606 may optionally be stored on storage device 610 either before or after execution by processor 604. Computer system 600 also includes a communication interface 618 coupled to bus 602.

Communication interface 618 provides a two-way data communication coupling to a network link 620 that is connected to a local network 622. For example, communication interface 618 may be an integrated services digital network (ISDN) card, cable modem, satellite modem, or a modem to provide a data communication connection to a corresponding type of telephone line. As another example, communication interface 618 may be a local area network (LAN) card to provide a data communication connection to a compatible LAN. Wireless links may also be implemented. In any such implementation, communication interface 618 sends and receives electrical, electromagnetic or optical signals that carry digital data streams representing various types of information.

Network link 620 typically provides data communication through one or more networks to other data devices. For example, network link 620 may provide a connection through local network 622 to a host computer 624 or to data equipment operated by an Internet Service Provider (ISP) 626. ISP 626 in turn provides data communication services through the world wide packet data communication network now commonly referred to as the "Internet" 628. Local network 622 and Internet 628 both use electrical, electromagnetic or optical signals that carry digital data streams. The signals through the various networks and the signals on network link 620 and through communication interface 618, which carry the digital data to and from computer system 600, are example forms of transmission media.

Computer system 600 can send messages and receive data, including program code, through the network(s), network link 620 and communication interface 618. In the Internet example, a server 630 might transmit a requested code for an application program through Internet 628, ISP 626, local network 622 and communication interface 618.

The received code may be executed by processor 604 as it is received, and/or stored in storage device 610, or other non-volatile storage for later execution.

9. Equivalents, Extensions, Alternatives and Miscellaneous

In the foregoing specification, example embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method comprising:

receiving two or more input audio data portions of a common time window index value, the two or more input audio data portions being respectively generated based on responses of two or more microphones to sounds occurring at a location;

generating two or more pluralities of subband portions from the two or more input audio data portions, each plurality of subband portions in the two or more pluralities of subband portions corresponding to a respective input audio data portion of the two or more input audio data portions;

determining (a) a peak power and (b) a noise floor for each subband portion in each plurality of subband portions in the two or more pluralities of subband portions, thereby determining a plurality of peak powers and a plurality of noise floors for the plurality of subband portions;

applying a time-wise smoothing filter to the plurality of peak powers to generate a plurality of smoothed banded power for the plurality of subband portions, wherein the time-wise smoothing filter is applied with a smoothing factor that is chosen to enhance direct sound and a decay factor that is chosen to suppress reverberations;

computing, based at least in part on a plurality of smoothed banded powers and a plurality of noise floors for each plurality of subband portions in the two or more pluralities of subband portions, a plurality of weight values for the plurality of subband portions, thereby computing two or more pluralities of weight values for the two or more pluralities of subband portions;

generating, based on the two or more pluralities of subband portions and two or more pluralities of weight values for the two or more pluralities of subband portions, an integrated audio data portion of the common time window index;

wherein the method is performed by one or more computing devices.

2. The method as claimed in claim 1, wherein each of the two or more input audio data portions comprises frequency domain data in a time window indexed by the common time window index.

3. The method as claimed in claim 1, wherein the two or more microphones comprise a reference microphone for which weight values are calculated differently from how other weight values for other microphones of the two or more microphones are calculated.

4. The method as claimed in claim 1, wherein the two or more microphones are free of a reference microphone for which weight values are calculated differently from how other weight values for other microphones of the two or more microphones are calculated.

5. The method as claimed in claim 1, wherein an individual subband portion in a plurality of subband portions in the two or more pluralities of subband portions corresponds to an individual audio frequency band in a plurality of audio frequency bands spanning across an overall audio frequency range.

6. The method as claimed in claim 5, wherein the plurality of audio frequency bands represents a plurality of equivalent rectangular bandwidth (ERB) bands, or wherein the plurality of audio frequency bands represents a plurality of linearly spaced frequency bands.

7. The method as claimed in claim 1, wherein the peak power is determined from a smoothened banded power of a corresponding subband portion.

8. The method as claimed in claim 1, wherein the two or more microphones comprise at least one of soundfield microphones or mono microphones.

9. The method as claimed in claim 1, further comprising computing a plurality of spread spectral power levels from the plurality of peak powers.

10. The method as claimed in claim 1, wherein the two or more pluralities of weight values are collectively normalized to a fixed value.

11. The method as claimed in claim 1, wherein the two or more pluralities of weight values comprise individual weight values for subband portions all of which correspond to a specific equivalent rectangular bandwidth (ERB) band, and wherein the individual weight values for the subband portions are normalized to one.

12. The method as claimed in claim 1, wherein the individual weight values for the subband portions comprises a weight value for one of the subband portions; further comprising determining, based at least in part on the weight value for the one of the subband portions, one or more weight values for one or more constant-sized subband portions in two or more pluralities of constant-sized subband portions for the two or more input audio data portions.

13. The method as claimed in claim 1, wherein a weight value for a subband portion related to a microphone is proportional to the larger of a spectral spread peak power level of the microphone or a maximum noise floor among all other microphones.

14. The method as claimed in claim 1, wherein a weight value for a subband portion related to a non-reference microphone in the two or more microphones is proportional to the larger of a spectral spread peak power level of the non-reference microphone or a noise floor of a reference microphone in the two or more microphones.

15. The method as claimed in claim 1, wherein each input audio data portion of the two or more input audio data portions of the common time window index value is derived from an input signal generated by a respective microphone of the two or more microphones at the location, wherein the input signal comprises a sequence of input audio data portions of a sequence of time window indexes, wherein the sequence of input audio data portions includes the input audio data portion, and wherein the sequence of time window indexes includes the common time window index.

16. The method as claimed in claim 1, further comprising generating an integrated signal with a sequence of integrated audio data portions of a sequence of time window indexes, wherein the sequence of integrated audio data portions includes the integrated audio data portion, and wherein the sequence of time window indexes includes the common time window index.

17. The method as claimed in claim 1, wherein computing, based at least in part on a plurality of peak powers and a plurality of noise floors for each plurality of subband portions in the two or more pluralities of subband portions, a plurality of weight values for the plurality of subband portions comprises:

determining a smoothed spectral power for each subband portion in each plurality of subband portions in the two or more pluralities of subband portions, thereby determining a plurality of smoothed spectral power for the plurality of subband portions, wherein the smoothed spectral power for the subband portion comprises spectrally smoothed contributions of the estimated peak power for the subband portion and zero or more estimated peak powers for zero or more other subbands in the plurality of subband portions;

calculating, based on a plurality of smoothed spectral powers and a plurality of noise floors for each plurality of subband portions in the two or more pluralities of subband portions, the plurality of weight values for the plurality of subband portions.

18. The method as claimed in claim 1, further comprising deriving an estimated peak power for each subband portion in each plurality of subband portions in the two or more pluralities of subband portions by applying the time-wise smoothing filter to the peak power and a previous estimated peak power for the subband portion in the plurality of subband portions in the two or more pluralities of subband portions and a previous smoothed banded power derived for the subband portion.

19. A non-transitory medium having software stored thereon, the software including instructions for controlling at least one apparatus to:

receiving two or more input audio data portions of a common time window index value, the two or more input audio data portions being respectively generated based on responses of two or more microphones to sounds occurring at a location;

generating two or more pluralities of subband portions from the two or more input audio data portions, each plurality of subband portions in the two or more pluralities of subband portions corresponding to a respective input audio data portion of the two or more input audio data portions;

determining (a) a peak power and (b) a noise floor for each subband portion in each plurality of subband portions in the two or more pluralities of subband portions, thereby determining a plurality of peak powers and a plurality of noise floors for the plurality of subband portions;

applying a time-wise smoothing filter to the plurality of peak powers to generate a plurality of smoothed banded power for the plurality of subband portions, wherein the time-wise smoothing filter is applied with a smoothing factor that is chosen to enhance direct sound and a decay factor that is chosen to suppress reverberations;

computing, based at least in part on a plurality of smoothed banded powers and a plurality of noise floors for each plurality of subband portions in the two or more pluralities of subband portions, a plurality of weight values for the plurality of subband portions, thereby computing two or more pluralities of weight values for the two or more pluralities of subband portions;

generating, based on the two or more pluralities of subband portions and two or more pluralities of weight values for the two or more pluralities of subband portions, an integrated audio data portion of the common time window index;

wherein the method is performed by one or more computing devices.

20. A computer system comprising at least one memory, at least one communication mechanism, and at least one processor in communication with the at least one memory and the at least one communication mechanism, the at least one processor being adapted for:

receiving two or more input audio data portions of a common time window index value, the two or more input audio data portions being respectively generated based on responses of two or more microphones to sounds occurring at a location;

generating two or more pluralities of subband portions from the two or more input audio data portions, each plurality of subband portions in the two or more pluralities of subband portions corresponding to a respective input audio data portion of the two or more input audio data portions;

determining (a) a peak power and (b) a noise floor for each subband portion in each plurality of subband portions in the two or more pluralities of subband portions, thereby determining a plurality of peak powers and a plurality of noise floors for the plurality of subband portions;

applying a time-wise smoothing filter to the plurality of peak powers to generate a plurality of smoothed banded power for the plurality of subband portions, wherein the time-wise smoothing filter is applied with a smoothing factor that is chosen to enhance direct sound and a decay factor that is chosen to suppress reverberations;

computing, based at least in part on a plurality of smoothed banded powers and a plurality of noise floors for each plurality of subband portions in the two or more pluralities of subband portions, a plurality of weight values for the plurality of subband portions, thereby computing two or more pluralities of weight values for the two or more pluralities of subband portions;

generating, based on the two or more pluralities of subband portions and two or more pluralities of weight values for the two or more pluralities of subband portions, an integrated audio data portion of the common time window index;

wherein the method is performed by one or more computing devices.

* * * * *